US005437378A

United States Patent [19]

Ta

[11] Patent Number: 5,437,378

[45] Date of Patent: Aug. 1, 1995

[54] SPIRAL TIE RACK

[76] Inventor: Thien Q. Ta, 7658 Cerritos Ave. #G, Stanton, Calif. 90680

[21] Appl. No.: 229,194

[22] Filed: Apr. 18, 1994

Related U.S. Application Data

[63] Continuation-in-part of Ser. No. 76,152, Jun. 14, 1993, abandoned.

[51] Int. Cl.[6] ..... A47F 5/00

[52] U.S. Cl. ..... 211/115; 211/116

[58] Field of Search ..... 211/115, 116, 95, 163, 211/205, 196

[56] References Cited

U.S. PATENT DOCUMENTS

D. 281,931 12/1985 Arnold et al. .
D. 326,573 6/1992 Crawford et al. .
433,859 8/1890 Foster ..... 211/95
874,318 12/1907 Flugum ..... 211/115 X
879,004 2/1908 Rice ..... 211/116
1,933,203 10/1933 Azwell ..... 211/163 X
3,204,779 9/1965 Warner ..... 211/205 X
4,709,838 12/1987 Campbell ..... 211/115 X
4,750,627 6/1988 Myers ..... 211/205

OTHER PUBLICATIONS

"prior art" photographs submitted by applicant.

*Primary Examiner*—Robert W. Gibson, Jr.
*Attorney, Agent, or Firm*—David A. Testardi

[57] ABSTRACT

A rack includes a plurality of horizontally disposed tie support arms which are rigidly fixed to a central pole. The tie support arms are so arranged as to spiral at least partly around the central pole. A hook is rotatably connected to a top portion of the central pole and is adapted to suspend the central pole from a closet rod. The rack facilitates quick and easy access to any one of a plurality of ties or similar items which are hung from the tie support arms.

20 Claims, 10 Drawing Sheets

SPIRAL TIE RACK

CROSS-REFERENCE TO RELATED APPLICATION

This application is a continuation-in-part of U.S. patent application Ser. No. 08/076,152 filed on Jun. 14, 1993 now abandoned.

BACKGROUND OF THE INVENTION

1. Field of the Invention

The present invention pertains to the field of apparel hangers. More particularly, the present invention pertains to the field of hanging racks which are adapted to simultaneously suspend a plurality of ties or belts.

2. Description of the Related Art

The prior art reveals various racks which are adapted to simultaneously suspend a plurality of ties or other items. In the merchandizing industry, the use of floor standing racks for simultaneously displaying a plurality of ties, belts, or similar accessories is commonplace. In a typical floor standing display rack, a plurality of radially extending, circumferentially spaced support elements are employed to suspend a plurality of individual ties. This configuration is revealed in U.S. Pat. No. 238,405, incorporated by reference herein.

Other floor standing clothes and display racks have been proposed which include a plurality of generally horizontally disposed, radially extending support elements which spiral down a central vertical member. Such a configuration is shown, for example, in U.S. Pat. No. 326,573 and in U.S. Pat. Nos. 1,933,203 and 1,089,290, all of which are incorporated by reference herein.

Additionally, there have been proposed several racks which are adapted to be suspended from a horizontal bar (such as a closet rod) and which are adapted to suspend a plurality of ties. These racks are disclosed in the following U.S. Pat. Nos., all of which are incorporated by reference herein: 4,863,043; 4,709,838; 3,872,973; 2,459,417; Des. 281,931; and Des. 272,501.

SUMMARY OF THE INVENTION

It is an object of the present invention to provide a spiral rack which facilitates quick and easy access to any one of a plurality of ties, belts, or other items of apparel.

It is a further object of the invention to provide a tie rack which is adapted to be suspended from a horizontal closet rod in a rotatable manner and which includes a plurality of tie support arms which spiral down a central pole in a substantially helical manner.

It is yet a further object of the invention to provide a belt rack which is adapted to be suspended from a horizontal closet rod in a rotatable manner and which includes a plurality of belt support arms which spiral down a central pole in a substantially helical manner.

In one respect, the invention relates to a rack for hanging ties and similar items. The rack includes a central pole having a first end and a second end. A hook is connected to the first end of the central pole in a relatively rotatable manner, the hook including a curved portion which is adapted to be supported by a horizontal closet rod. A plurality of tie support arms are rigidly fixed to and extend outwardly from the central pole, the tie support arms being spaced at substantially uniform circumferential intervals around the axis of the central pole with each of the tie support arms being arranged at a circumferentially distinct position on the central pole. Moreover, each of the tie support arms terminates at a free end, and the free ends of the tie support arms are arranged so as to define at least one portion of at least one substantially helical curve.

In another respect, the invention relates to a rack which includes a central pole and a hook. A rotatable connection means is provided for connecting the hook to a first end of the central pole in a relatively rotatable manner. The rack further includes apparel supporting means for supporting a plurality of apparel items at circumferentially spaced positions around the central pole, the apparel supporting means including a plurality of support arms rigidly connected to the periphery of the central pole. The support arms are arranged so as to spiral at least partly around the central pole.

In yet another respect, the invention relates to a spiral rack adapted to simultaneously suspend a plurality of apparel items, the rack including a hook having a curved portion which is adapted to be supported by a horizontal closet rod, a central pole having a first end and a second end, connecting means for connecting the hook to the first end of the central pole in a relatively rotatable manner, and apparel supporting means for supporting a plurality of apparel items at circumferentially spaced positions around the central pole, the apparel supporting means including a plurality of support arms rigidly fixed to and extending outwardly from the central pole. In this respect, each of the support arms terminates at a free end, and the free ends of the support arms are arranged so as to define at least one portion of at least one substantially helical curve.

The invention will, however, be best understood by a review of the following specification in conjunction with the accompanying drawings in which:

DETAILED DESCRIPTION OF THE PREFERRED EMBODIMENTS

Figure 1:
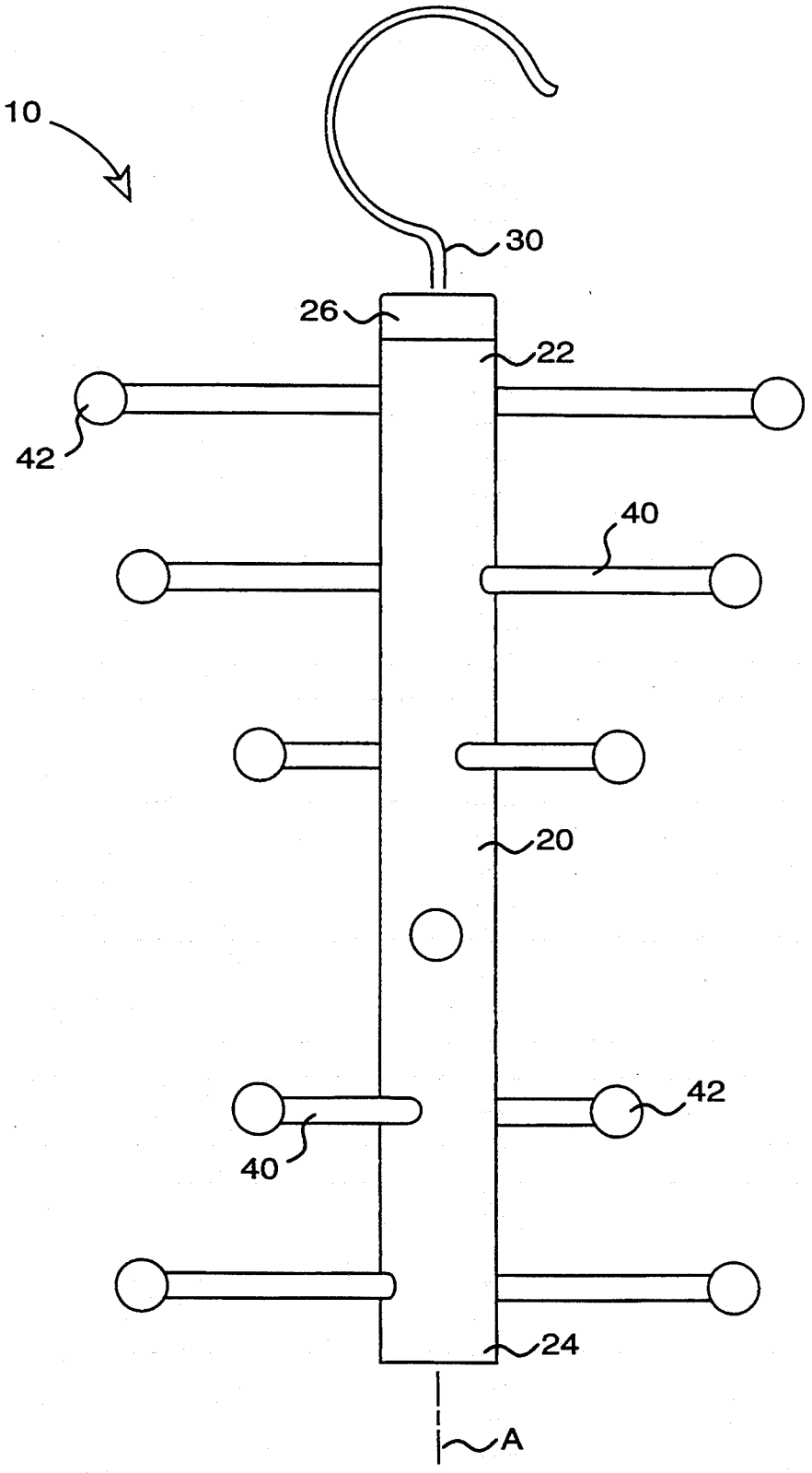
FIG. 1 reveals a frontal view of a spiral tie rack according to a first preferred embodiment of the invention.
Figure 2:
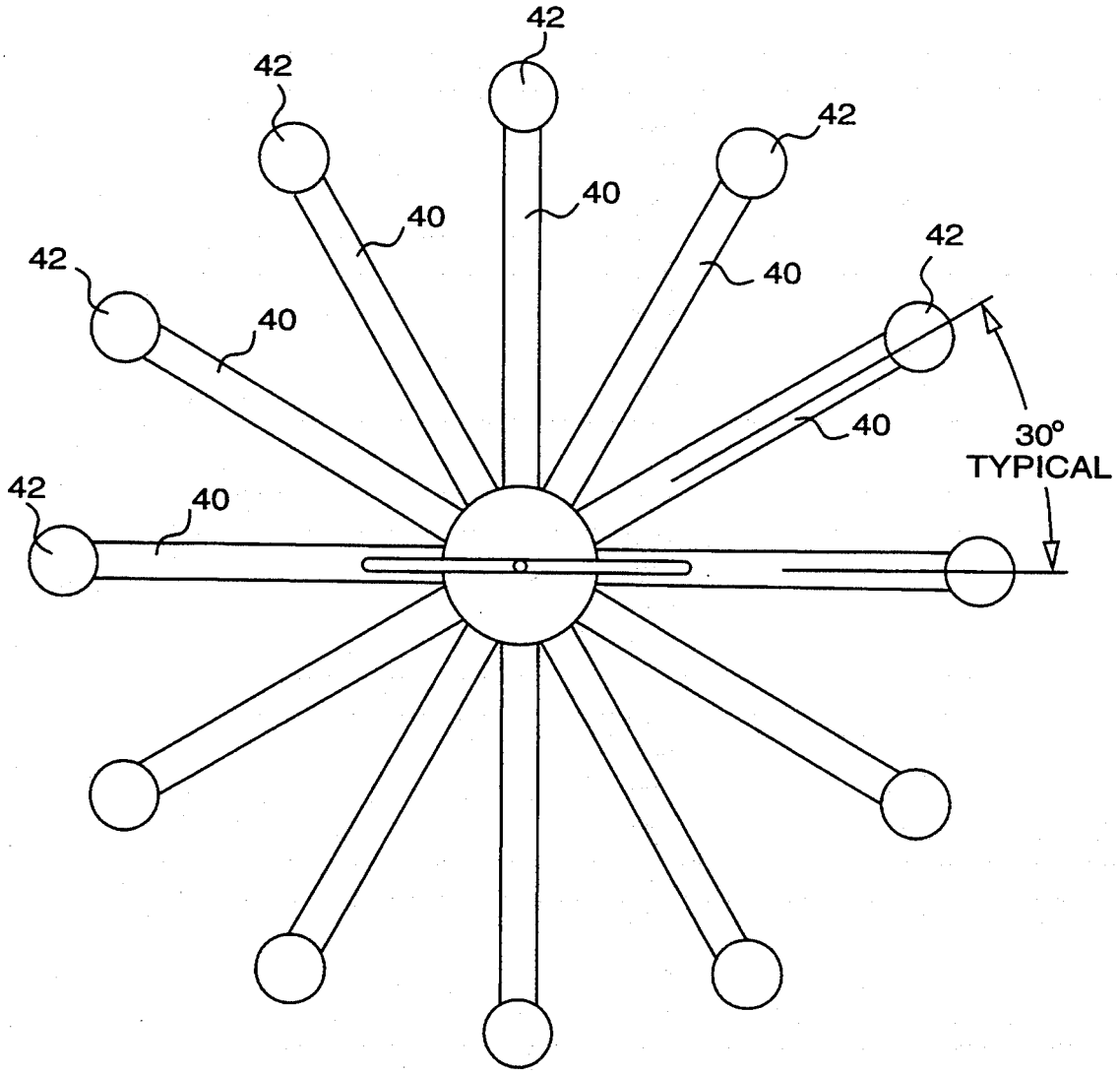
FIG. 2 reveals a top view of the spiral tie rack shown in FIG. 1.

Referring to FIGS. 1 and 2, a spiral tie rack 10 according to the first preferred embodiment comprises a central pole 20 (made from wood, plastic, or other suitable material) having a first end 22 and a second end 24 and defining an axis A. A cap member 26 is fixed (e.g. by chemical bonding and/or form locking) to the first end 22 of the central pole 20, and a metallic hook 30 is connected to the cap member 26 in a relatively rotatable manner as will be described hereinafter with reference to FIG. 6. A plurality of tie support arms 40 (preferably made from the same material as the central pole) are rigidly fixed to the central pole 20 (e.g. by chemical bonding, friction locking, and/or form locking) and extend radially or substantially radially outwardly therefrom. Each of the tie support arms 40 occupies a circumferentially distinct (angular) position around (or on) the central pole 20. That is, no two tie support arms 40 are aligned axially along the central pole 20. Moreover, each tie support arm 40 terminates in an enlarged, substantially spherically shaped free end 42 which functions as a means for preventing accidental removal of ties from the tie support arm.

According to the first preferred embodiment of the invention, the free ends 42 of the tie support arms are arranged so as to define (or substantially define) at least one portion of at least one helix. Specifically, referring for example to FIGS. 1 and 2, the twelve tie support arms 40 extend substantially radially from the central pole 20 and are arranged such that the free ends 42 of six circumferentially adjacent tie support arms 40 (e.g. as numbered "42" in FIG. 2; hereinafter called the first group of tie support arms) define (or substantially define) a portion of a first cylindrical helix while the free ends of the other six tie support arms (hereinafter called the second group of tie support arms) define (or substantially define) a portion of a second cylindrical helix. As shown for example in FIG. 2, the tie support arms are so arranged as to be uniformly (or substantially uniformly) spaced apart from one another at 30 degree intervals in the circumferential direction. Consequently, the portion of the first cylindrical helix defined between (or by) the free ends of the first group of tie support arms extends less than 180 degrees (i.e. 150 degrees) around the axis A of the central pole 20. Similarly, the portion of the second cylindrical helix defined between (or by) the free ends of the second group of tie support arms extends less than 180 degrees (i.e. 150 degrees) around the axis A of the central pole 20. Moreover, as is most clearly evident from FIG. 1, the portion of the first cylindrical helix defined between (or by) the free ends of the first group of tie support arms is coaxial with and phase shifted by 180 degrees relative to the portion of the second cylindrical helix defined between (or by) the free ends of the second group of tie support arms.

To use the spiral tie rack according to the first preferred embodiment, individual ties (or other items of apparel) are draped over and supported on individual ones of the tie support arms 40 at circumferentially spaced positions around the central pole 20. As such, the support arms 40 constitute means for supporting a plurality of ties (or other items of apparel) at circumferentially spaced positions around the central pole. It will be apparent to those skilled in the art that the spiral tie rack according to the first preferred embodiment is thus .capable of individually supporting up to twelve ties at circumferentially spaced positions around the central pole. Of course, it is conceivable that two or more ties could be supported on each support arm, thereby permitting more than twelve ties to be supported on the spiral tie rack. It will be further apparent that this arrangement facilitates the hanging, identification, and removal of ties from the rack.

Figure 3:
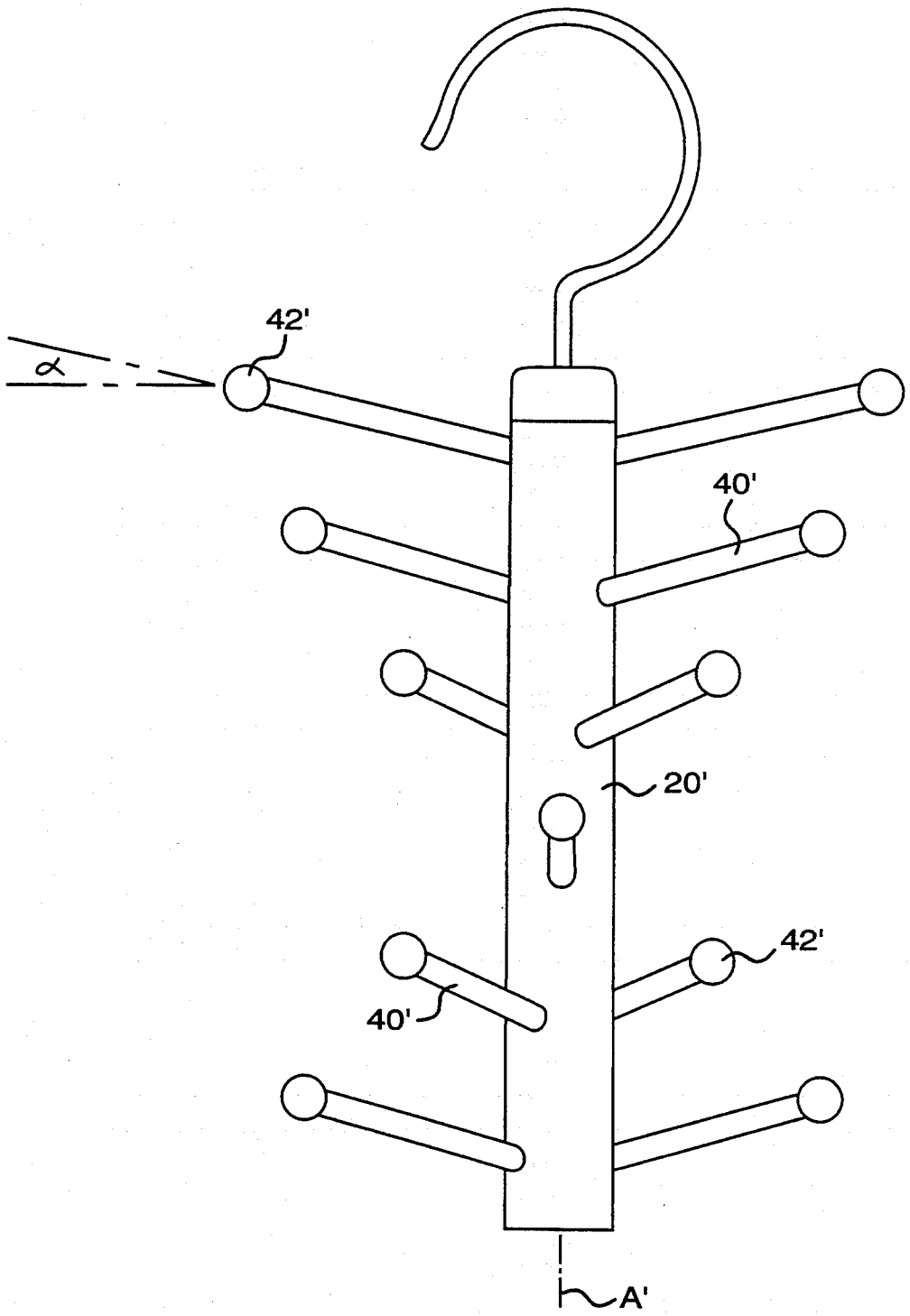
FIG. 3 reveals a frontal view of a spiral belt rack according to second preferred embodiment of the invention.

FIG. 3 reveals a frontal view of a modified version of the spiral rack shown in FIGS. 1 and 2 which is particularly adapted for use as a belt rack. The embodiment of FIG. 3 is substantially identical to the embodiment of FIGS. 1 and 2 except that, in FIG. 3, the twelve support arms 40' are rigidly fixed to the central pole 20' in such a manner that they extend in upwardly angled directions away from the axis A' of central pole 20'. That is, as shown in FIG. 3, each of the support arms 40' extends in an upward direction and defines an angle $\alpha$ (e.g. of between 10 and 15 degrees) with a plane that extends perpendicularly to the axis A' of the central pole 20'. As with the embodiment of FIGS. 1 and 2, each of the twelve tie support arms 40' terminates in a free end 42', and the free ends 42' of the twelve support arms 40' are arranged so as to substantially define portions of two helical curves which are phase shifted by 180 degrees relative to one another, with each of the helical curves extending through an angle of less than 180 degrees (i.e. 150) degrees relative to the axis A' of the central pole 20'.

While the embodiments of FIGS. 1 to 3 has been described with reference to a preferred number of support arms and helical curve portions, the invention need not be so limited. For example, according to the preferred embodiments of the invention which employ evenly spaced support arms within regularly arranged helix portions, it is merely necessary that the circumferential spacing $\beta$ (in degrees) between adjacent support arms, the number of support arms S, the angular extent $\theta$ (in degrees) of each helix portion around the central pole, and the number of helix portions H be correlated in such a manner that:

$$\beta * S \leqq 360°;$$

and $$H * \theta \leqq [360° - (H * \beta)].$$

Thus, as will be apparent to those skilled in the art, the sum total of the angular extents of all of the regularly arranged helix portions (e.g. whether there be one or several) in the spiral tie rack according to the preferred embodiments is always less than 360 degrees.

Figure 4:
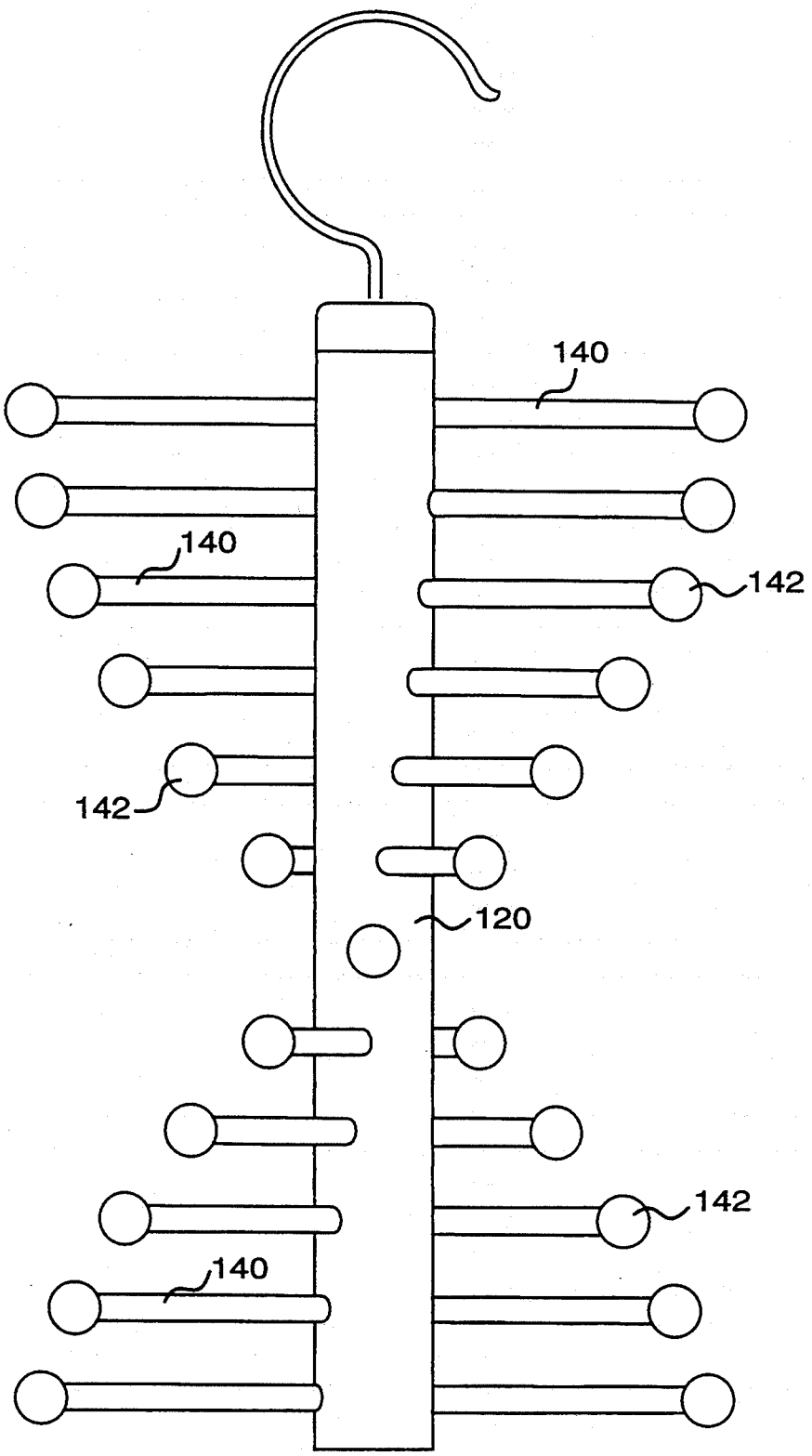
FIG. 4 reveals a frontal view of a spiral tie rack according to a third preferred embodiment of the invention.
Figure 5:
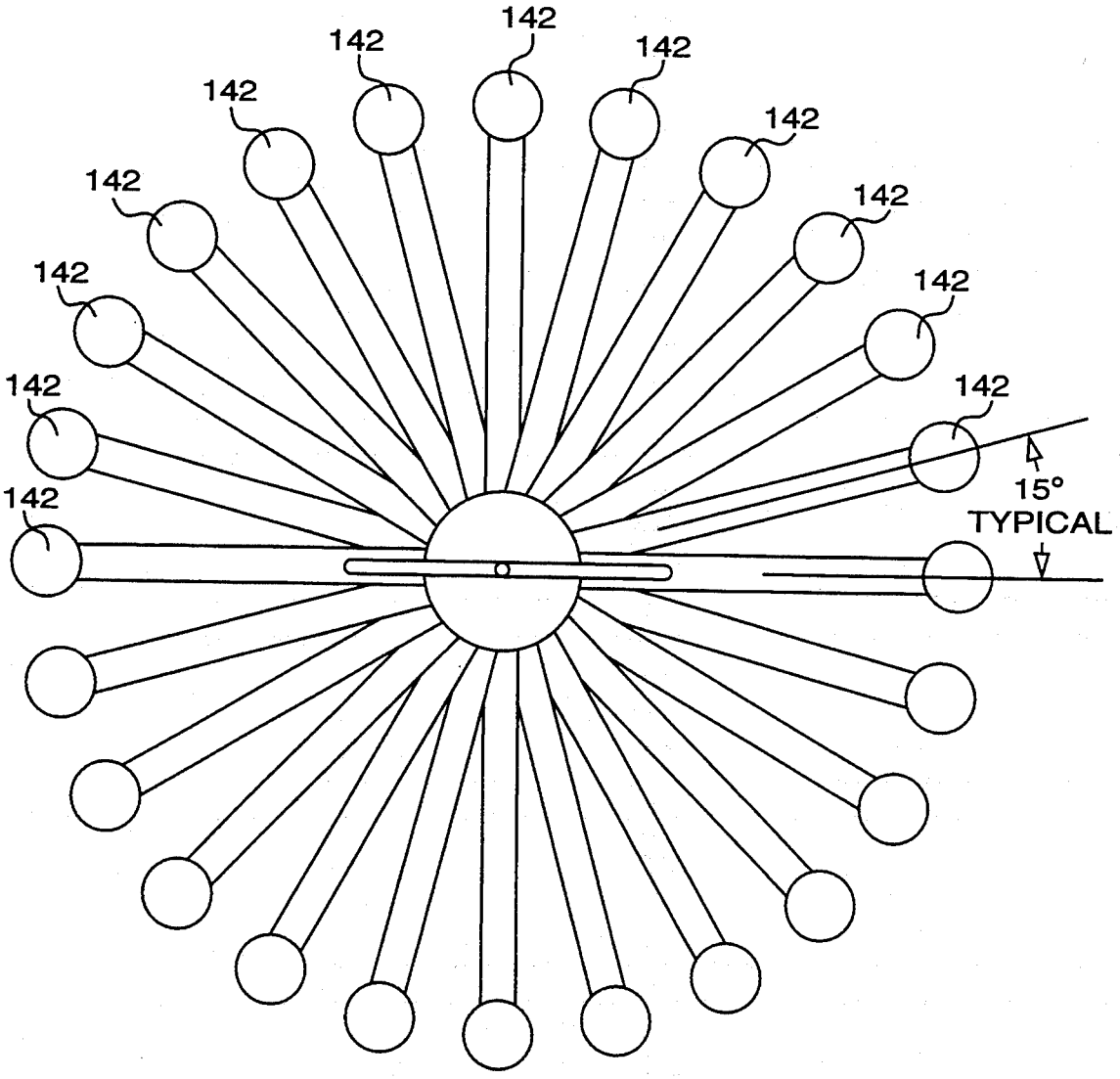
FIG. 5 reveals a top view of the spiral tie rack shown in FIG. 4.

FIGS. 4 and 5 reveal an embodiment of the invention which is substantially identical to the embodiment of FIGS. 1 and 2 in both structure and use except that more than twelve tie support arms are employed. Specifically, as shown in these Figures, twenty-four tie support arms 140 are rigidly fixed to and extend substantially radially outwardly from the central pole 120. In this case, the free ends 142 of a first group of twelve circumferentially adjacent tie support arms (e.g. as numbered in FIG. 5) are arranged so as to define (or substantially define) the portion of the first cylindrical helix, while the free ends of the remaining twelve tie support arms are arranged so as to define (or substantially define) the portion of the second cylindrical helix. Moreover, the portion of the first cylindrical helix defined between (or by) the free ends of the first group of tie support arms extends through less than 180 degrees (i.e. 165 degrees) relative to the axis of the central pole, and the portion of the second cylindrical helix defined between (or by) the free ends of the second group of tie support arms extends through less than 180 degrees (i.e.

165 degrees) relative to the axis of the central pole. Additionally, the portion of the first cylindrical helix is coaxial with and phase shifted by 180 degrees relative to the portion of the second cylindrical helix, and the tie support arms 140 are spaced from each other at uniform (or substantially uniform) circumferential intervals around the axis of the central pole (i.e. 15 degrees).

Figure 6:
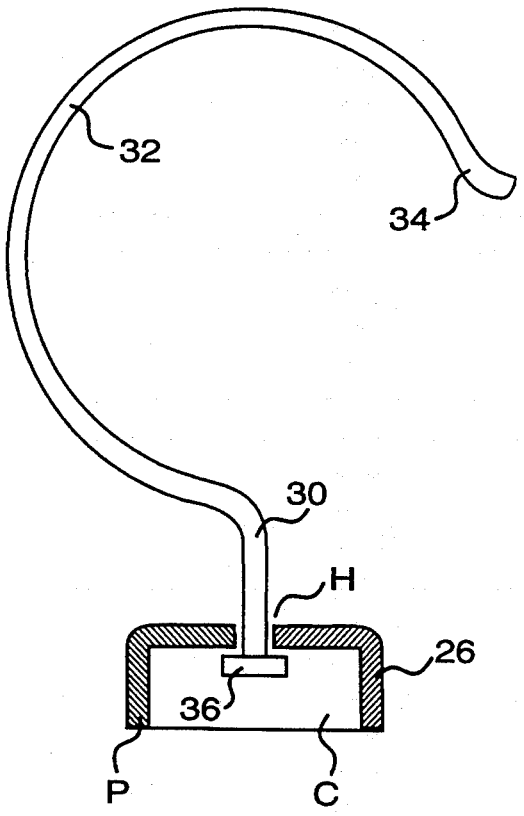
FIG. 6 reveals a cross-sectional view of the cap member of the spiral tie and belt racks in FIGS. 1 to 5.

FIG. 6 reveals the details of the rotatable connection between the hook 30 and the cap member 26 in FIGS. 1 and 2. As seen in this FIG., the hook has a curved portion 32 which is adapted to be supported by a horizontal closet rod. The curved portion 32 terminates in a free end 34. The end of the hook opposite to the free end 34 is provided with an enlargement 36 for the purpose described below.

The cap member 26 (which is preferably made from the same material as the central pole) has a central hole H at a top portion thereof, an annular periphery P at a bottom portion thereof, and an internal cavity C intermediate the central hole and the annular periphery. The hook 30 extends through the central hole C in a rotatable manner (that is, an annular clearance exists between the top portion of the cap member and the hook), while the enlargement 36 is retained within the internal cavity C, and the annular periphery P is securely fastened to the first end (e.g. 22) of the central pole. In this manner, a rotatable connection is effected between the hook 30 and the central pole 20 which permits rotation of the tie rack while the hook remains suspended by a closet rod.

Figure 7:
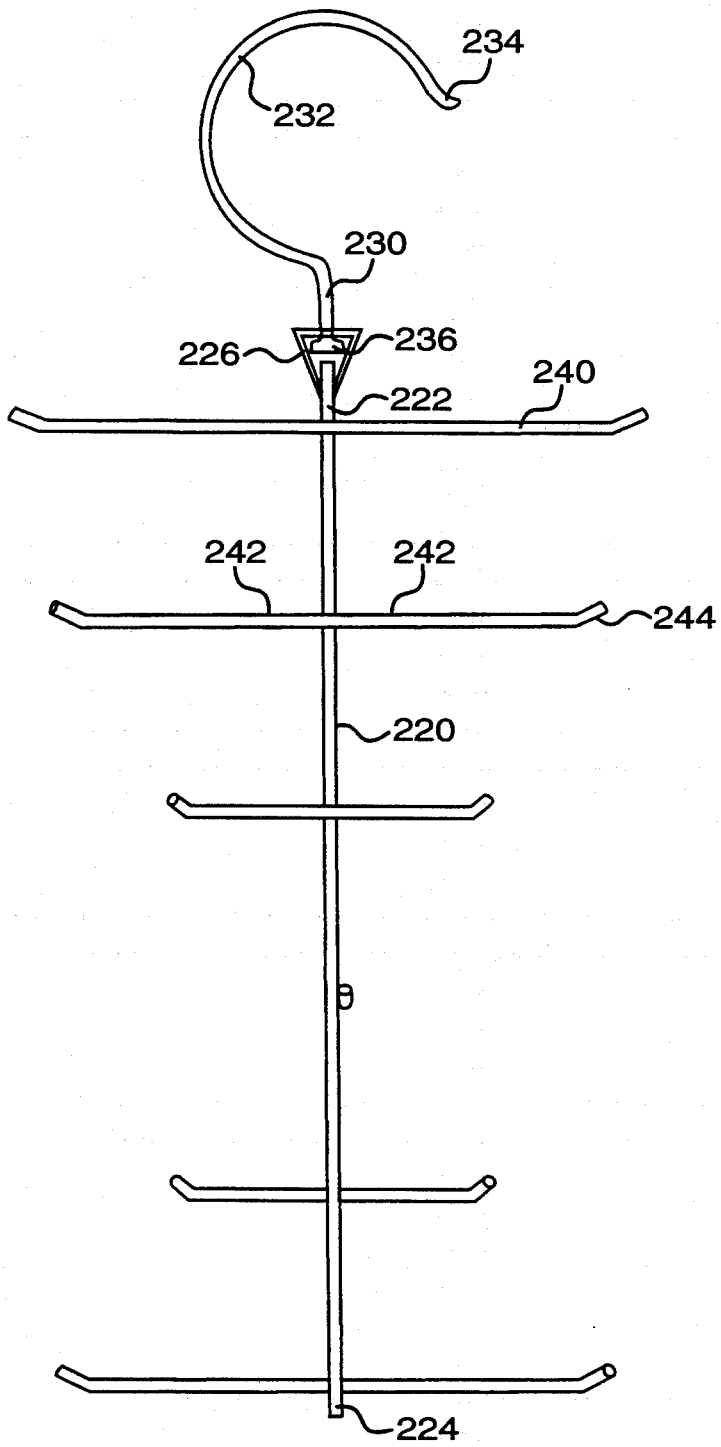
FIG. 7 reveals a frontal view of a spiral tie rack according to a fourth preferred embodiment of the invention.
Figure 8:
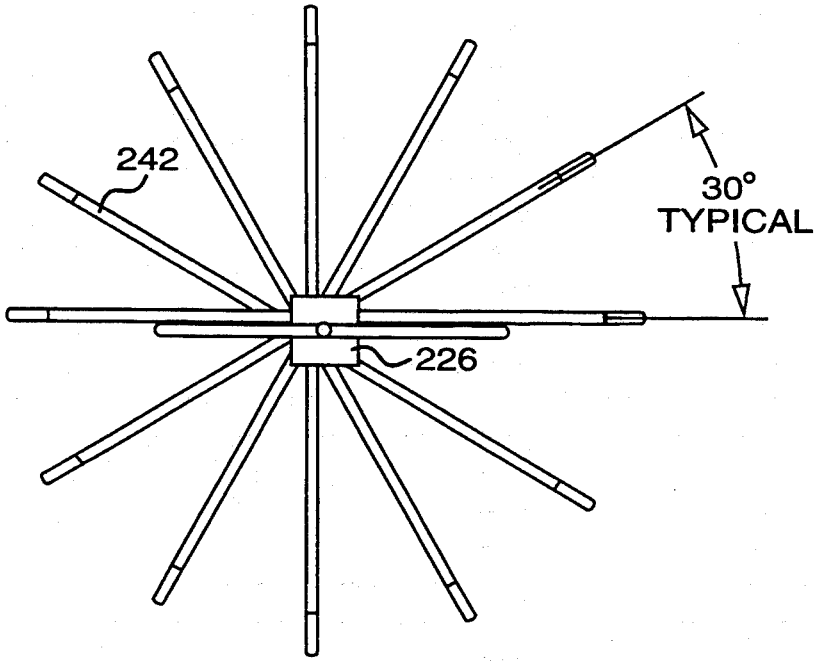
FIG. 8 reveals a top view of the spiral tie rack shown in FIG. 7.

FIGS. 7 and 8 reveal a fourth embodiment of the invention wherein the central pole and the tie support arms are made from relatively thick metal wire. As shown in the Figures, a central pole 220 is rotatably connected to a hook 230 by means of a retaining member 226 (to be described hereinafter). A plurality of (e.g. six) cross-bars 240 are rigidly connected to the periphery of the central pole (e.g. by means of welding, brazing, soldering, or chemical bonding) so as to extend substantially (or generally) diametrically of the central pole. The central pole thus effectively divides each cross-bar 240 into two arms (e.g. depicted at 242) which extend substantially (or generally) radially outwardly from the central pole for supporting ties and similar items.

The tie support arms 242, which are spaced at substantially uniform circumferential intervals around the central pole and which each occupy a distinct circumferential position around (or on) the central pole, are arranged so as to spiral at least partly around the central pole 220 between first and second axial ends 222, 224 thereof. As shown in FIG. 7, each tie support arm 242 comprises a free end 244 which is bent relative to a main (horizontal) portion of the tie support arm. The function of the bent free end is to inhibit accidental removal of ties from the rack. In particular, the bent free end serves as a means for preventing accidental removal of ties from the support arm.

As shown in FIG. 7, the hook 230 has a curved portion 232 which is adapted to be supported by a horizontal closet rod and which terminates in a free end 234. An enlargement 236 is provided on an end of the hook opposite the free end 234. The retaining member 226 (which is formed of bent sheet metal or the like and which is nonrotatably fixed to the central pole 220 by means of welding, brazing, soldering, or chemical bonding) has a central hole at a top portion thereof (similar to the hole H in FIG. 6), and the hook 230 extends through the central hole in a rotatable manner such that the enlargement 236 and the curved portion 232 are disposed on opposite sides of the retaining member 226. In this manner, the enlargement 236 is retained between the top portion of the retaining member 226 and the first end 222 of the central pole 220.

The spatial arrangement of the tie support arms 242 in FIGS. 7 and 8 is substantially the same as the spatial arrangement of the tie support arms 40 depicted and described with reference to FIGS. 1 and 2. That is, the free ends of a first group of six circumferentially adjacent tie support arms 242 are arranged so as to substantially define a portion of a first cylindrical helix (e.g. which extends from the bottom left to the top right portion of FIG. 7), and the free ends of a second group of six circumferentially adjacent tie support arms 242 are arranged so as to substantially define a portion of a second cylindrical helix (e.g. extending from the bottom right to the top left portion of FIG. 6). The portion of the first cylindrical helix extends through less than 180 degrees (i.e. 150 degrees) relative to an axis of the central pole, and the portion of the second cylindrical helix extends through less than 180 degrees (i.e. 150 degrees) relative to the axis of the central pole. Moreover, the portion of the first cylindrical helix is coaxial with and phase shifted by 180 degrees relative to the portion of the second cylindrical helix.

To use the spiral tie rack according to the fourth preferred embodiment, individual ties (or other items of apparel) are draped over and supported on individual ones of the tie support arms 242 at circumferentially spaced positions around the central pole 220. As such, the support arms 242 constitute means for supporting a plurality of ties (or other items of apparel) at circumferentially spaced positions around the central pole.

Figure 9:
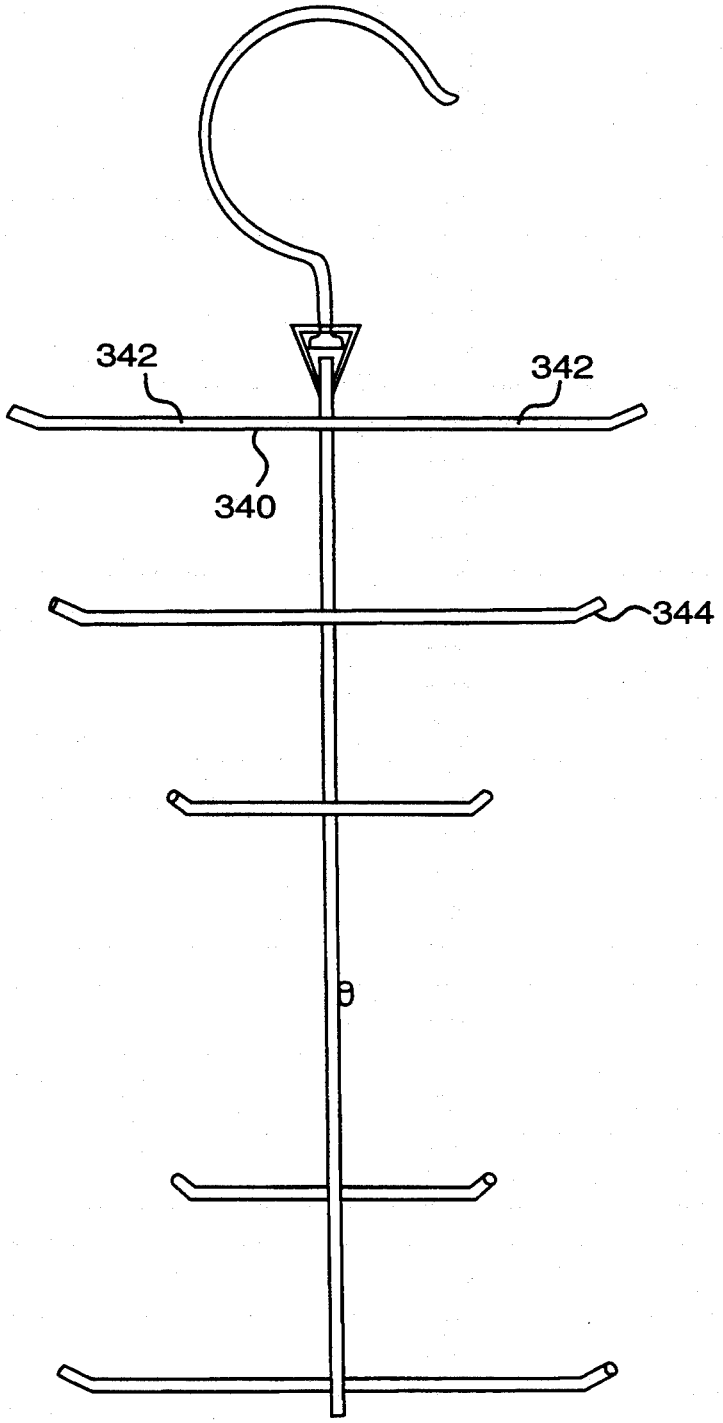
FIG. 9 reveals a frontal view of a spiral tie rack according to a fifth preferred embodiment of the invention.
Figure 10:
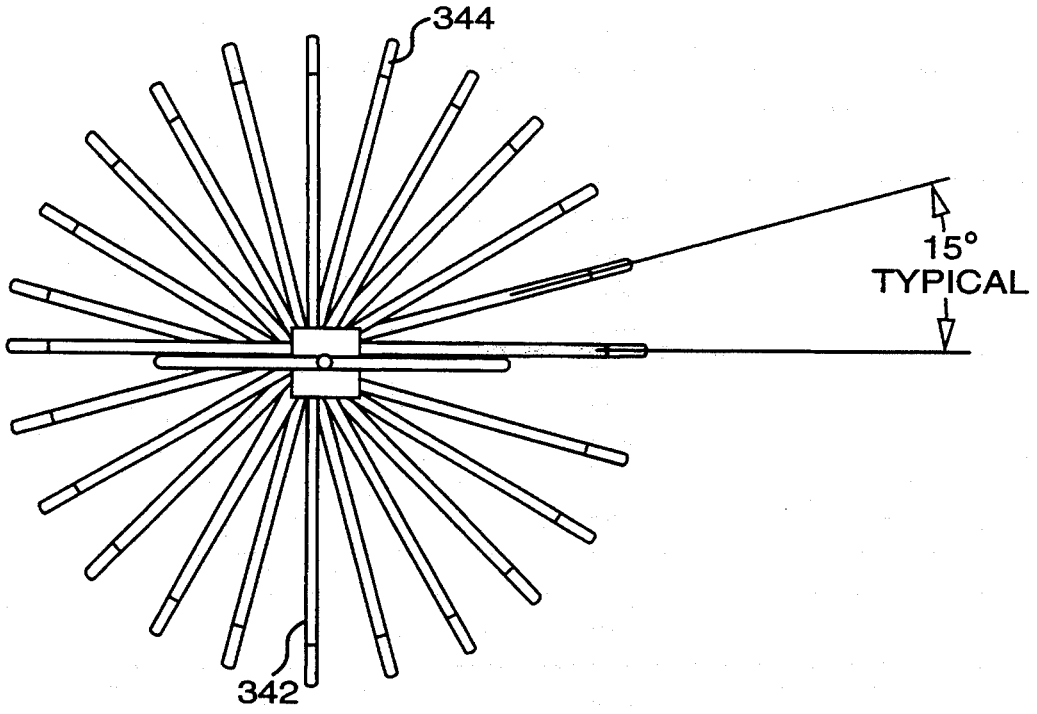
FIG. 10 reveals a top view of the spiral tie rack shown in FIG. 9.

FIGS. 9 and 10 reveal an embodiment of the invention which is substantially identical to the embodiment of FIGS. 7 and 8 in both structure and use except that more than twelve tie support arms are employed. Specifically, as shown in these Figures, twenty-four substantially (or generally) radially extending tie support arms 342 are defined by twelve cross-bars 340. The cross-bars 340 are rigidly fixed to and extend substantially (or generally) diametrically of the central pole. In this case, the free ends 344 of a first group of twelve circumferentially adjacent tie support arms 342 are arranged so as to substantially define the portion of the first cylindrical helix, while the free ends of the remaining twelve tie support arms are arranged so as to substantially define the portion of the second cylindrical helix. Moreover, the portion of the first cylindrical helix defined between (or by) the free ends 344 of the first group of tie support arms extends through less than 180 degrees (i.e. 165 degrees) relative to the axis of the central pole, and the portion of the second cylindrical helix defined between (or by) the free ends 344 of the second group of tie support arms extends through less than 180 degrees (i.e. 165 degrees) relative to the axis of the central pole. Additionally, the portion of the first cylindrical helix is coaxial with and phase shifted by 180 degrees relative to the portion of the second cylindrical helix, and the tie support arms 342 are spaced from each other at substantially uniform circumferential intervals around the axis of the central pole (i.e. 15 degrees).

According to the preferred embodiments, the spiral racks are sized and configured to as to fit readily within a clothes closet. That is, the central pole is dimensioned so as to be less than about eighteen inches in length, preferably less than twelve inches in length, and optimally less than ten inches in length. For example, in the preferred embodiments of FIGS. 1 and 4, the central poles 20, 120 have lengths of approximately 7.5 and 9.5 inches, respectively. Furthermore, each of the support arms extends outwardly from the central pole by a horizontal distance of less than about four inches, preferably less than three inches, and optimally approximately two inches. Moreover, an angular spacing between any two circumferentially adjacent ones of the support arms (e.g. 40, 40', 140, 240, 340) is selected to be not greater than (i.e less than or equal to) approximately 60 degrees, preferably not greater than 45 degrees, and optimally not greater than 30 degrees.

According to the preferred embodiments, each of the portions of the substantially helical curves are defined by at least four (and optimally at least six) of the free ends of the support arms, and each of the portions of the substantially helical curves extends through an angular extent of less than 360 degrees relative to the axis of the central pole.

While the invention has been described with certain particularity, it is not meant to be limited to the above described preferred embodiments. For example, the circumferential spacings between the individual support arms need not be uniform. Moreover, the circumferential spacings between the support arms in the first helix portion may be different from those in the second helix portion. The helix portions need not be cylindrical. Instead of arranging the free ends of the support arms so as to form portions of two substantially cylindrical helices, spiral racks may be fabricated in which the free ends of the support arms are arranged so as to form a portion of one helix or portions of three or more helices. The hook could be replaced with another equivalent structural element (such as a separable strap) configured and arranged so as to be supportable by (and readily removable from) a horizontal closet rod. Therefore, the present invention will include the disclosed embodiments and any modifications thereof which will fall within the scope of the appended claims.

In the appended claims, a portion of a substantially helical curve is not to be defined by the free ends of less than three support arms. Moreover, the circumferential spacing (relative to the axis of the central pole) between at least two adjacent ones of the three free ends which define the portion of the substantially helical curve must not be greater than approximately 60 degrees.

I claim:

1. A rack for hanging ties and similar items, comprising:

a central pole having a first end and a second end and defining an axis;

a hook connected to the first end of the central pole in a relatively rotatable manner, the hook including a curved portion which is adapted to be supported by a horizontal closet rod; and a plurality of tie support arms rigidly fixed to and extending outwardly from the central pole, wherein the tie support arms are spaced at substantially uniform circumferential intervals around the axis of the central pole with each of the tie support arms being arranged at a circumferentially distinct position on the central pole;

wherein each of the tie support arms terminates at a free end, and wherein the free ends of the tie support arms are arranged so as to define at least one portion of at least one substantially helical curve.

2. The rack as recited in claim 1, wherein the rack includes at least twelve of the tie support arms, wherein the free ends of the at least twelve tie support arms are arranged so as to define portions of two substantially helical curves, and wherein each of the substantially helical curves extends through less than 180 degrees relative to the axis of the central pole.

3. The rack as recited in claim 1, wherein the free ends of the tie support arms are arranged so as to define portions of two substantially helical curves which are phase shifted by 180 degrees relative to one another, and wherein each of the substantially uniform circumferential intervals is less than or equal to approximately 60 degrees.

4. The rack as recited in claim 1, wherein at least twelve of the tie support arms are arranged around the central pole so as to extend substantially radially outwardly therefrom, wherein the at least one portion of the at least one substantially helical curve consists of a portion of a first cylindrical helix and a portion of a second cylindrical helix, wherein the free ends of a first group of at least six of the tie support arms are arranged so as to define the portion of the first cylindrical helix, and wherein the free ends of a second group of at least six of the tie support arms are arranged so as to define the portion of the second cylindrical helix.

5. The rack as recited in claim 4, wherein the portion of the first cylindrical helix extends through less than 180 degrees relative to the axis of the central pole, wherein the portion of the second cylindrical helix extends through less than 180 degrees relative to the axis of the central pole, and wherein the portion of the first cylindrical helix is coaxial with and phase shifted by 180 degrees relative to the portion of the second cylindrical helix.

6. The rack as recited in claim 1, wherein the free end of each of the tie support arms comprises an enlarged portion.

7. The rack as recited in claim 1, wherein the hook has a curved portion, which is adapted to be supported by a horizontal closet rod and which terminates in a free end, wherein an enlargement is provided on an end of the hook opposite the free end thereof, and wherein the rack further comprises:

a cap member having a central hole at a top portion thereof, an annular periphery at a bottom portion thereof, and an internal cavity intermediate the central hole and the annular periphery;

wherein the hook extends through the central hole in a rotatable manner, wherein the enlargement is retained within the internal cavity, and wherein the annular periphery of the cap member is securely fastened to the first end of the central pole.

8. The rack as recited in claim 1, wherein at least six of the tie support arms are arranged around the central pole, wherein the free ends of the at least six tie support arms define one portion of one substantially helical curve, and wherein the one portion of the one substantially helical curve defined by the free ends of the at least six tie support arms extends through an angular extent of less than 360 degrees relative to the axis of the central pole.

9. The rack as recited in claim 1, wherein twenty-four of the tie support arms are arranged around the central pole so as to extend substantially radially outwardly therefrom, wherein the at least one portion of the at least one substantially helical curve comprises a portion of a first cylindrical helix and a portion of a second cylindrical helix, wherein the free ends of a first group of twelve of the tie support arms are arranged so as to define the portion of the first cylindrical helix, wherein the free ends of a second group of twelve of the tie support arms are arranged so as to define the portion of the second cylindrical helix, wherein the portion of the first cylindrical helix extends through less than 180 degrees relative to the axis of the central pole, wherein the portion of the second cylindrical helix extends through less than 180 degrees relative to the axis of the ,central pole, wherein the portion of the first cylindrical helix is coaxial with and phase shifted by 180 degrees relative to the portion of the second cylindrical helix, and wherein the tie support arms are spaced from each other at uniform circumferential intervals around the axis of the central pole.

10. A rack, comprising:

a central pole defining a periphery and having first and second axial ends;

a hook;

rotatable connection means for connecting the hook to the first end of the central pole in a relatively rotatable manner; and apparel supporting means for supporting a plurality of apparel items at circumferentially spaced positions around the central pole, the apparel supporting means including a plurality of support arms rigidly connected to the periphery of the central pole;

wherein the support arms are arranged so as to spiral at least partly around the central pole between the first and second axial ends thereof.

11. The rack as recited in claim 10, wherein the hook has a curved portion which is adapted to be supported by a horizontal closet rod and which terminates in a free end, wherein an enlargement is provided on an end of the hook opposite the free end thereof, and wherein the rotatable connection means comprises:

a retaining member fixed to the first axial end of the central pole;

wherein the retaining member has a central hole at a top portion thereof, wherein the hook extends through the central hole in a rotatable manner such that the enlargement and the curved portion are disposed on opposite sides of the retaining member, and wherein the enlargement is retained between the top portion of the retaining member and the first end of the central pole.

12. The rack as recited in claim 10, wherein the central pole and the support arms are made from metal wire.

13. The rack as recited in claim 10, wherein each support arm terminates in a free end and wherein each free end is bent relative to a main portion of the support arm.

14. The rack as recited in claim 10, wherein at least twelve of the support arms are arranged around the central pole, wherein each of the support arms extends generally radially outwardly from the central pole to a free end, wherein the free ends of a first group of at least six of the support arms are arranged so as to define a portion of a first substantiality helical curve, wherein the free ends of a second group of at least six of the support arms are arranged so as to define a portion of a second substantially helical curve, and wherein each of the support arms of the first group is formed integrally with a corresponding one of the support arms of the second group.

15. The rack as recited in claim 14, wherein the portion of the first substantially helical curve extends through less than 180 degrees relative to an axis of the central pole, wherein the portion of the second substantially helical curve extends through less than 180 degrees relative to the axis of the central pole, and wherein the portion of the first substantially helical curve is coaxial with and phase shifted by 180 degrees relative to the portion of the second substantially helical curve.

16. The rack as recited in claim 10, wherein the central pole defines an axis, wherein the support arms are spaced at substantially uniform circumferential intervals around the axis of the central pole, and wherein each of the support arms is arranged at a circumferentially distinct position around the central pole.

17. The rack as recited in claim 10, wherein each of the support arms is arranged at a circumferentially distinct position around the central pole and wherein an angular spacing between any two circumferentially adjacent ones of the support arms is not greater than approximately 60 degrees.

18. A spiral rack adapted to simultaneously suspend a plurality of apparel items, comprising:

a hook having a curved portion which is adapted to be supported by a horizontal closet rod;

a central pole having a first end and a second end;

connecting means for connecting the hook to the first end of the central pole in a relatively rotatable manner;

apparel supporting means for supporting a plurality of apparel items at circumferentially spaced positions around the central pole, the apparel supporting means including a plurality of support arms rigidly fixed to and extending outwardly from the central pole;

wherein each of the support arms terminates at a free end, the free ends of the support arms being arranged so as to define at least one portion of at least one substantially helical curve.

19. The spiral tie rack as recited in claim 18, wherein the central pole defines an axis and a periphery, wherein at least twelve of the support arms are arranged around the central pole so as to extend substantially radially outwardly therefrom, wherein the at least one portion of the at least one substantially helical curve consists of a portion of a first substantially helical curve and a portion of a second substantially helical curve, wherein the free ends of a first group of at least six of the support arms are arranged so as to define the portion of the first substantially helical curve, and wherein the free ends of a second group of at least six of the support arms are arranged so as to define the portion of the second substantially helical curve, wherein the portion of the first substantially helical curve extends through less than 180 degrees relative to the axis of the central pole, wherein the portion of the second substantially helical curve extends through less than 180 degrees relative to the axis of the central pole, and wherein the portion of the first substantially helical curve is coaxial with and phase shifted by 180 degrees relative to the portion of the second substantially helical curve, and wherein the support arms are spaced at substantially uniform angular intervals around the entire periphery of the central pole in such a manner that each of the support arms occupies a circumferentially distinct position around the periphery of the central pole.

20. The rack as recited in claim 18, wherein each of the support arms is arranged at a circumferentially distinct position around the central pole and wherein an angular spacing between any two circumferentially adjacent ones of the support arms is not greater than approximately 60 degrees.

* * * * *